US006226485B1

(12) United States Patent
Purizhansky

(10) Patent No.: US 6,226,485 B1
(45) Date of Patent: May 1, 2001

(54) TONER METERING BLADE AND MANUFACTURING PROCESS THEREFOR

(75) Inventor: Edward M. Purizhansky, Williamsville, NY (US)

(73) Assignee: TMP Technologies, Inc., Buffalo, NY (US)

( * ) Notice: Subject to any disclaimer, the term of this patent is extended or adjusted under 35 U.S.C. 154(b) by 0 days.

(21) Appl. No.: 09/490,399

(22) Filed: Jan. 24, 2000

(51) Int. Cl.[7] ..... G03G 15/08; G03G 15/09; G03G 15/00

(52) U.S. Cl. ..... 399/284; 399/109; 399/274

(58) Field of Search ..... 15/1.51; 118/261; 430/120; 399/123, 264, 273, 274, 283, 284, 350, 351, 109, 111; 156/94, 327, 329, 330, 304.5, 338

(56) References Cited

U.S. PATENT DOCUMENTS 6,029,031 * 2/2000 Yokomori et al. ..... 399/109
6,117,395 * 9/2000 Ploug et al. ..... 422/100
6,141,513 * 2/2000 Nishiuwatoko et al. ..... 399/199

FOREIGN PATENT DOCUMENTS 60-69678 * 4/1985 (JP) .

* cited by examiner

*Primary Examiner*—Arthur T. Grimley
*Assistant Examiner*—Hoang Ngo
(74) *Attorney, Agent, or Firm*—Walter W. Duft

(57) ABSTRACT

A toner metering blade includes an elongated blade holder and an elongated blade element. These components are bonding together, and a toner metering strip is optionally formed on one face of the blade element, in a single molding and material injection operation in which the blade holder is configured to provide a hot runner system.

20 Claims, 4 Drawing Sheets

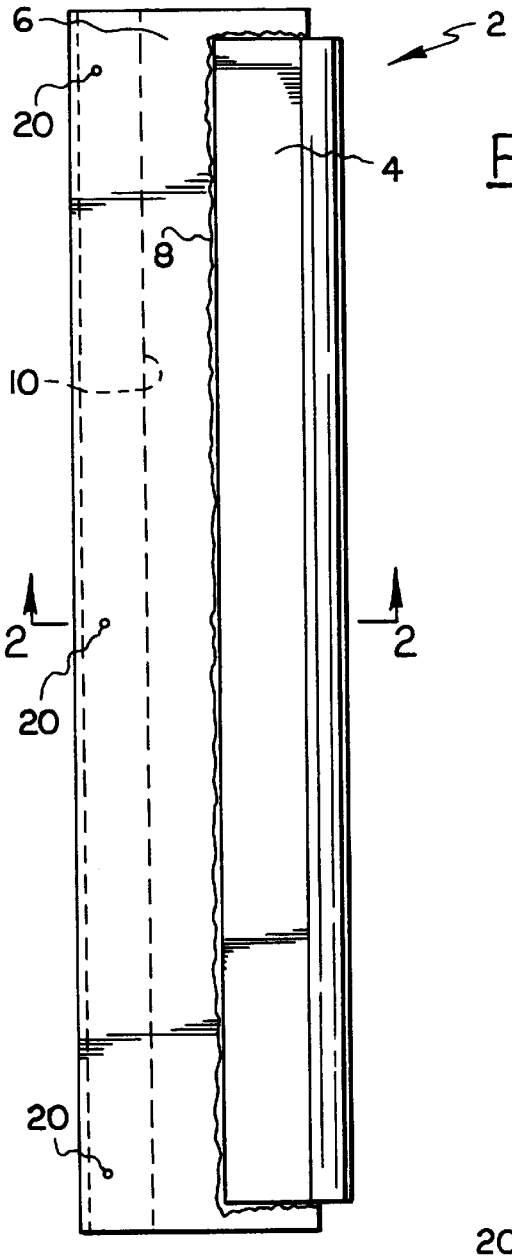
FIG. 1
PRIOR ART
FIG. 2
PRIOR ART
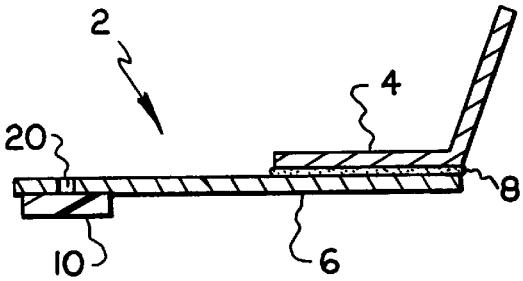
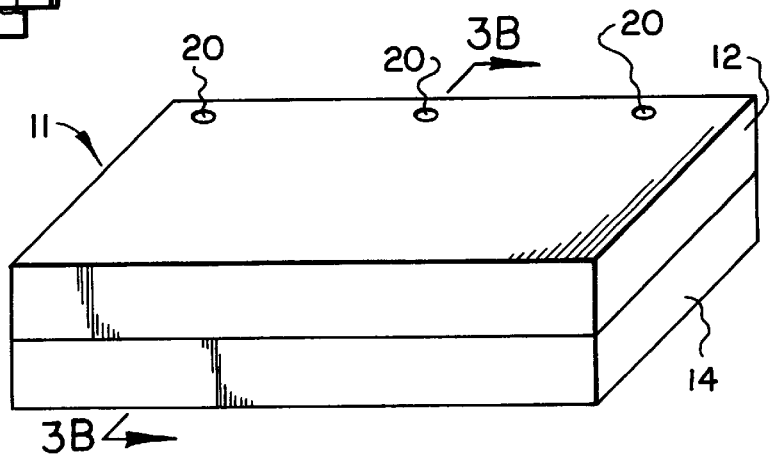
FIG. 3A
PRIOR ART

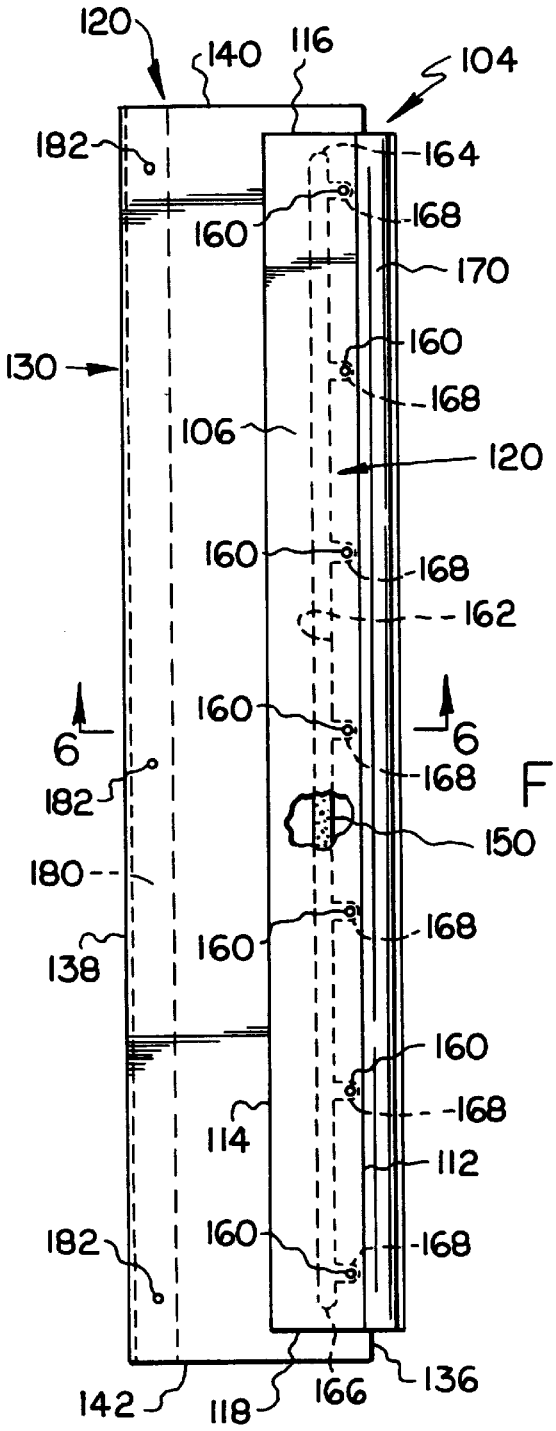
FIG. 5
FIG. 3B
PRIOR ART
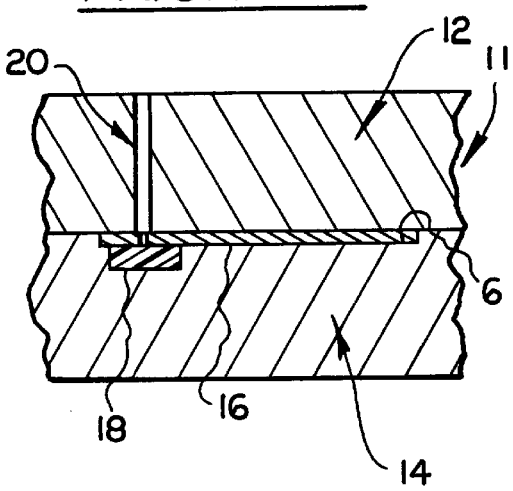
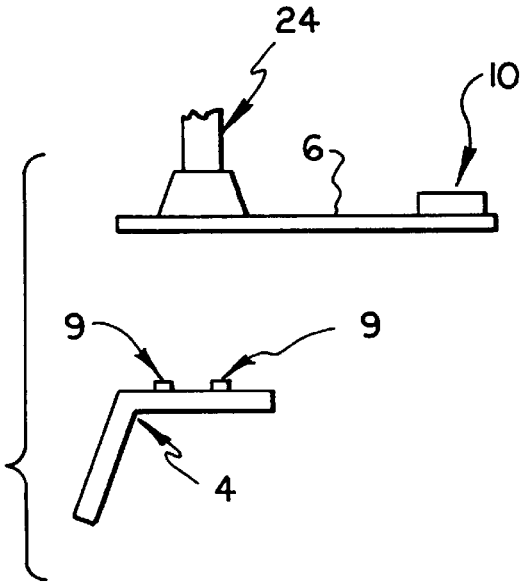
FIG. 4
PRIOR ART

FIG. 6
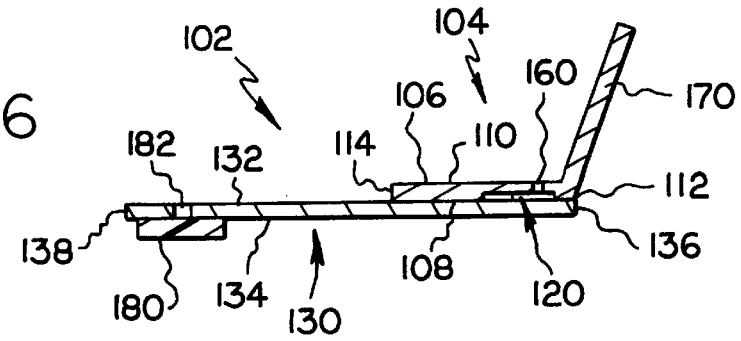
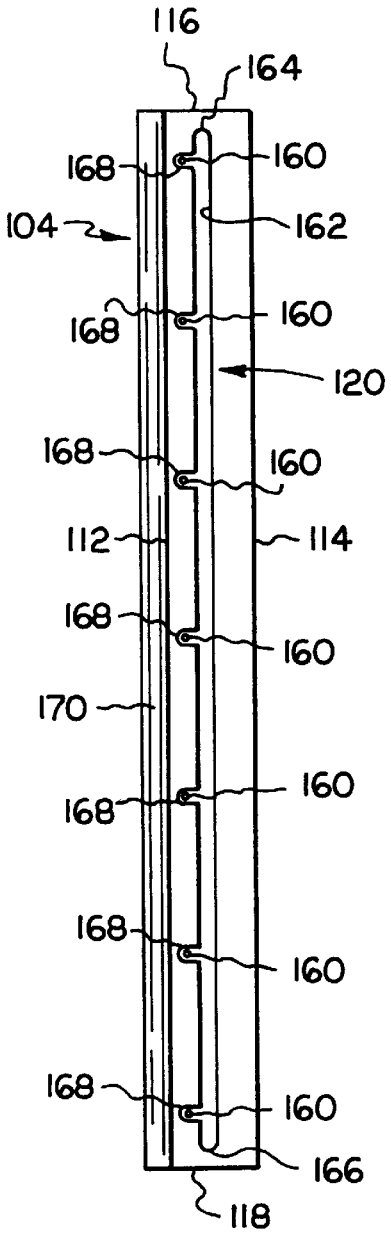
FIG. 7
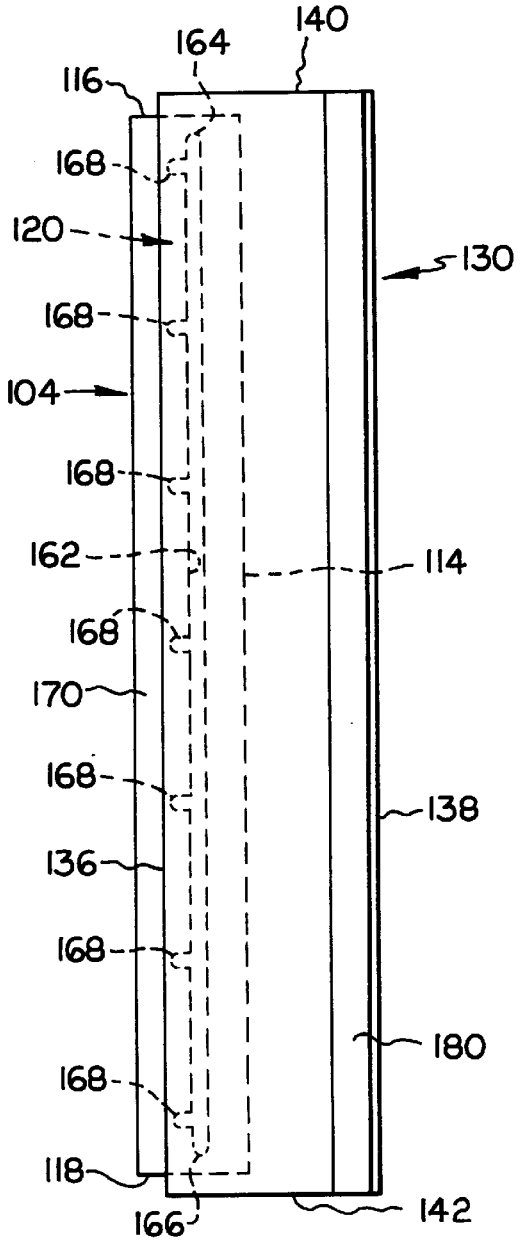
FIG. 8

TONER METERING BLADE AND MANUFACTURING PROCESS THEREFOR

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention relates to toner metering blades used for metering toner in imaging processing equipment. The invention further relates to a novel process for manufacturing toner metering blades.

By way of background, toner metering blades are used in the toner cartridges of photocopy machines, laser printers, and other image processing equipment to perform the useful function of controlling the amount of toner that is transferred from a toner reservoir onto an image forming component. As is known, the image forming component, which is typically a photosensitive drum, is first rotated past an image forming area, where a latent image is formed thereon by laser imaging or other means. The image forming component is then advanced through the toner reservoir, where toner adheres to the portions of the image forming component that bear the latent image, forming a toner image pattern. As the image forming component continues to rotate, the toner image pattern is brought into contact with a print medium, such as paper, to which the toner is transferred to form a permanent image.

A typical prior art toner metering blade includes an elongated blade holder with a thin elongated blade element attached thereto. The blade holder mounts to a fixed structure on the toner cartridge such that a free edge portion of the blade element is positioned in close proximity to the moving image forming component, at a location where the image forming component enters the toner reservoir. The toner metering blade thus serves to remove excess toner remaining on the image forming component following a printing operation and prior to its re-entry into the toner reservoir. A strip made from silicone rubber or the like is usually secured to the toner blade at the free edge thereof. This provides the additional function of statically charging the image forming component to assist in the transfer of toner to the latent image.

In the past, toner metering blades have been manufactured by bonding the blade element to the blade holder in an adhesive bonding operation. Prior to or after the adhesive bonding operation, the silicone strip is applied to the free edge of the blade element in a separate manufacturing operation. In some cases, the silicone strip is a calendared strip that is placed on the blade element and secured thereto by appropriate curing. More recently, applicant's assignee has developed a technique for molding the silicone strip to the blade element. This provides a secure attachment between the blade element and the strip and obviates the strip calendaring, strip placement and strip curing steps referred to above.

A remaining deficiency of prior art toner metering blades is that several processing operations are still required to fabricate such products. Moreover, the relative placement of the blade element onto the blade holder is not controllable with complete precision. In particular, when the blade element and the blade holder are joined together with the soft adhesive sandwiched therebetween, the components can "float" relative to one another in three-dimensional space until the adhesive sets up. This can increase manufacturing tolerances to unsatisfactory levels.

It is with overcoming the foregoing deficiencies of the prior art that the present invention is concerned.

BRIEF SUMMARY OF THE INVENTION

It is an object of the present invention to provide an improved toner metering blade with an improved bond between the blade holder and the blade element.

Another object of the present invention to provide an improved toner metering blade with an improved bond between the blade holder and the blade element, in combination with a well defined blade element strip.

Still another object of the present invention is to provide an improved process for manufacturing toner metering blades wherein the manufacturing steps are reduced in number and the manufacturing cycle time (per-unit) is held to a minimum.

In accordance with the present invention, a toner metering blade has an elongated blade holder and an elongated blade element. These components are bonded together—and a strip is optionally formed on one face of the blade element—in a single molding and material injection operation in which the blade holder is configured to provide a hot runner system.

In the preferred embodiment of the invention disclosed herein, the foregoing is accomplished by providing an elongated blade holder that is constituted, in part, by an elongated base member. The base member has a first blade holder face, a second blade holder face that is substantially parallel to the first blade holder face, a first longitudinal blade holder side edge, a second longitudinal blade holder side edge, a first blade holder end and a second blade holder end. An open blade holder cavity is formed in the first blade holder face for receiving an adhesive material, and at least one blade holder injection port extends from the second blade holder face to the cavity.

There is further provided an elongated blade element having a first blade element face, a second blade element face that is substantially parallel to the first blade element face, a first longitudinal blade element edge, a second longitudinal blade element edge, a first blade element end and a second blade element end.

During assembly of the foregoing components, the blade holder base member is placed onto the blade element such that the first blade element face is in facing engagement with the first blade holder face, and with the blade element covering the blade holder cavity. A mold is then closed around the blade holder and the blade element, the mold being shaped to receive the blade holder and the blade element therein and including a first mold gate that is located so as to be in fluid communication with the blade holder injection port when the mold is closed. There then follows the injection of a quantity of adhesive material into the first mold gate, the injecting of the adhesive material being sufficient to fill the blade holder cavity with the adhesive and to bond the blade holder to the blade element.

In a most preferred embodiment of the invention, the blade element includes plural blade element injection ports extending from the first blade element face to the second blade element face. The mold also includes (a) a strip-forming cavity located so as to be adjacent to the second blade element face and in fluid communication with the blade element injection ports when the mold is closed, and b) a set of second mold gates located so as to be in fluid communication with the blade element injection ports at the first blade element face when the mold is closed.

The manufacturing method then also includes injecting a quantity of strip-forming material into the second mold gates, the injecting of the strip-forming material being sufficient to fill the strip-forming cavity with the strip-forming material and form a strip on the blade element. Preferably, the strip is made from the same material as the adhesive. This material is preferably injected into the first and second mold gates substantially simultaneously.

The various aspects of the present invention will be more fully understood when the following portions of the specification are read in conjunction with the following drawings wherein:

BRIEF DESCRIPTION OF THE SEVERAL VIEWS OF THE DRAWING

FIG. 1 is a plan view of a prior art toner metering blade constructed according to a prior art manufacturing method;

FIG. 2 is a cross-sectional view taken along line 2—2 in FIG. 1;

FIG. 3A is a perspective view of a pair of mold plates used in a prior art toner metering blade manufacturing process;

FIG. 3B is a partial cross-sectional view taken along line 3B—3B in FIG. 3A, and showing a blade element of the prior art toner metering blade of FIG. 1 during a prior art manufacturing step wherein the blade element is seated in a mold that is used to form a longitudinal silicone strip along one side of the blade element;

FIG. 4 is a side elevational view of the blade element of FIG. 1 during a prior art manufacturing step in which the blade element is mounted on a blade holder;

FIG. 5 is a plan view (with a section broken away for clarity) of a toner metering blade constructed in accordance with the invention;

FIG. 6 is a cross-sectional view taken along line 6—6 in FIG. 5;

FIG. 7 is a plan view of a blade holder of the toner metering blade of FIG. 4 showing an adhesive runner system therein;

FIG. 8 is a bottom view of the toner metering blade of FIG. 5;

DETAILED DESCRIPTION OF THE INVENTION

Figure 9A:
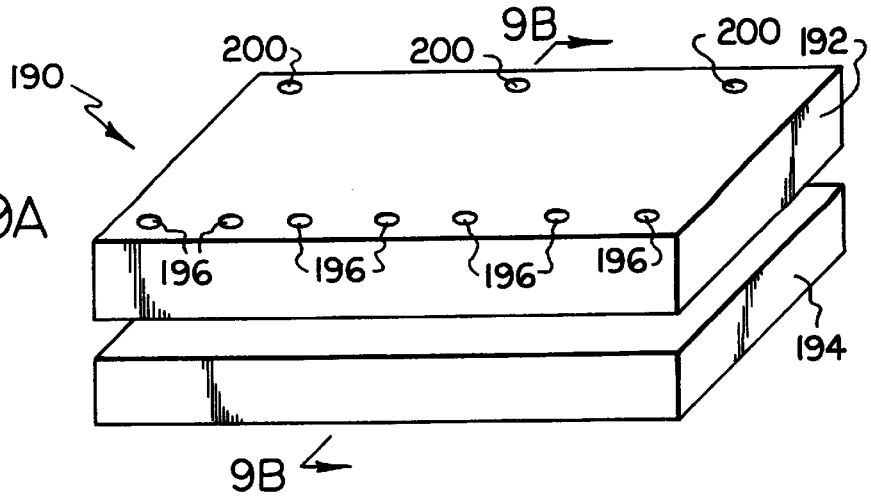
FIG. 9A is a perspective view of a pair of mold plates used in a toner metering blade manufacturing process in accordance with the invention.

In order to more fully appreciate the novel features of the invention, a review of the prior art toner metering blade and manufacturing method referred to in the Background section above will be presented with reference to FIGS. 1–4. Turning now to the FIGS. 1 and 2, a prior art toner metering blade 2 includes a steel blade holder 4 secured to a steel blade element 6 by way of an adhesive bond 8, formed from cured epoxy. A toner metering strip 10, made from silicone rubber, is attached to the blade element 6 using a prior art molding process as will now be described.

FIGS. 3A, 3B and 4 illustrate the prior art process used to manufacture the toner metering blade 2. As shown in FIG. 3B, the blade element 6, which has not yet been attached to the blade holder 4, is seated in a mold 11 comprising upper and lower mold plates 12 and 14, respectively. The purpose of this molding operation is to form the toner metering strip 10 onto the blade element 6. To that end, the lower mold plate includes a cavity 16 for receiving the blade element 6. The cavity 16 includes an enlarged portion 18, which is shaped to define the toner metering strip 10.

As shown in FIGS. 1 and 2, the blade element 6 is formed with three small holes 20 located near one longitudinal edge of the blade element 6. When the blade element 6 is positioned in the mold 11, the holes are aligned with three corresponding mold gates 22 (see FIGS. 3A and 3B) that are formed in the upper mold plate 12. To form the toner metering strip 10, a suitable material, such as silicone rubber, is introduced into the gates 22. The material is then injected through the holes 20, which serve as injection ports, into the enlarged portion 18 of the lower mold cavity 16.

Turning now to FIG. 4, the blade element 6 is removed from the mold 11 after the toner metering strip 10 cures. Using a robotically controlled suction device 24, the blade element 6 is placed on the blade holder 4, to which one or two beads 9 of adhesive material have been pre-dispensed. Suitable pressure and/or heat are then be applied to set up the adhesive bond 8.

Turning now to FIGS. 5–8, an improved toner metering blade 102 made in accordance with a preferred embodiment of the present invention is shown. The toner metering blade 102 features an elongated blade holder 104, made from steel or the like, that is constituted in part by an elongated base member 106. The elongated base member 106 has a first blade holder face 108, a second blade holder face 110 that is substantially parallel to the first blade holder face 108, a first longitudinal blade holder side edge 112, a second longitudinal blade holder side edge 114, a first blade holder end 116 and a second blade holder end 118. An open cavity 120 is formed in the first blade holder face 108 for receiving an adhesive material.

An elongated blade element 130, also made from steel or the like, has a first blade element face 132, a second blade element face 134 that is substantially parallel to the first blade element face 132, a first longitudinal blade element edge 136, a second longitudinal blade element edge 138, a first blade element end 140 and a second blade element end 142. The blade element 130 is disposed on the blade holder base member 106 such that the first blade element face 132 is in facing engagement with the first blade holder face 108, and with the blade element 130 covering the cavity 120. A quantity of adhesive 150 (see FIG. 5), such as silicone rubber, fills the cavity 120 to provide a bond between the blade holder 104 and the blade element 130.

The blade holder 104 preferably includes at least one blade holder injection port 160 extending from the second blade holder face 110 to the cavity 120 for introducing the adhesive material 150 into the cavity. By way of example only, FIGS. 5 and 7 show the blade holder 104 in a configuration with seven blade holder injection ports 160.

The cavity 120 preferably includes an elongated channel 162 extending substantially parallel to the first and second blade holder longitudinal edges 112 and 114, and having first and second ends 164 and 166 disposed substantially adjacent to the first and second blade holder ends 116 and 118, respectively. To accommodate the injection ports 160, the cavity 120 preferably further includes plural fingers 168 connecting the injection ports 160 to the elongated channel 162.

The blade holder 104 and the blade element 130 are arranged such that the first longitudinal blade holder edge 112 is substantially parallel with and adjacent to the first longitudinal blade element edge 136. The blade holder 104 may further include an angled side member 170 connected to the first longitudinal blade holder edge 112 and extending away from the blade element 130. The side member 170 can be used in conventional fashion for mounting the toner metering blade 102 to external structure.

The blade element 130 preferably includes a toner metering strip 180 mounted on the second blade element face 134, substantially adjacent to the second blade element edge 138. The blade element 130 preferably also includes plural blade element injection ports 182 (three are shown) extending from the first blade element face 132 to the second blade element face 134. The injection ports 182 are provided for injecting a material therethrough to form the toner metering strip 180, as described in more detail below. For ease of manufacturing, the toner metering strip 180 can be made from the same material as the adhesive 150, e.g., silicone rubber. For reasons which will become apparent below, this material will usually fill the blade holder injection ports 160 and the blade element injection ports 182 in the finished toner metering blade 102.

Figure 9B:
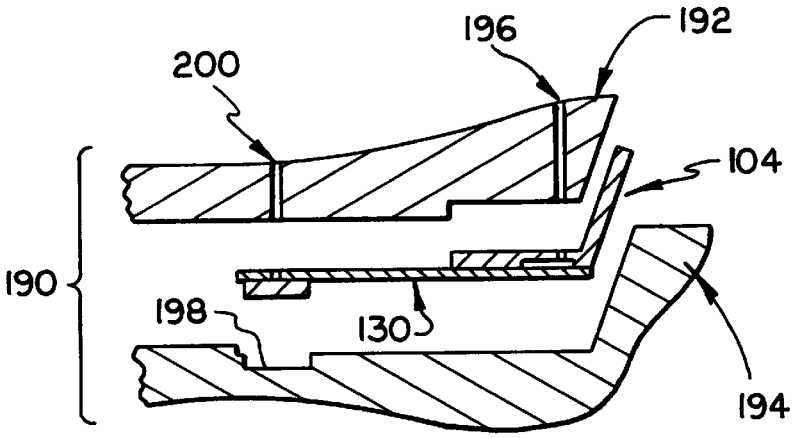
FIG. 9B is a partial cross-sectional view taken along line 9B—9B in FIG. 9A, and showing the toner metering blade of FIG. 5 and a mold used to manufacture the toner metering blade in accordance with the invention.

Turning now to FIGS. 9A and 9B, a process for manufacturing the toner metering blade 102 will now be described. The manufacturing process begins with providing the blade holder 104 and the blade element 130 as separate components in unassembled form. A mold 190 having an upper mold plate 192 and a lower mold plate 194 is then used to complete the remainder of the manufacturing process of FIGS. 9A and 9B. The blade element 130 is placed on the lower mold plate 194 with the second blade element face 134 contacting the mold plate upper surface. The blade holder base member 106 is placed onto the blade element 130. This placement is such that the first blade element face 132 is in facing engagement with the first blade holder face 108, and with the blade element 130 covering the blade holder cavity 120.

The mold plates 192 and 194 are now brought together to close the mold 190 around the blade holder 104 and the blade element 130. As shown in FIG. 9B, the mold 190 is appropriately shaped to receive the blade holder and the blade element therein. It also includes at least one mold gate 196 located so as to be in fluid communication with the blade holder injection port(s) 160 when the mold 190 is closed. Thus, when the blade holder 104 includes plural blade holder injection ports 160, there will be a corresponding number of the mold gates 196 aligned therewith.

To complete the manufacturing process of FIGS. 9A and 9B, a quantity of the adhesive material 150 is injected into the mold gate(s) 196. This causes the adhesive material to flow through the blade holder injection ports 160, into the finger portions 168 of the cavity 120, and into the elongated chamber 162. The blade holder 104, and specifically the cavity 120, effectively provide a hot runner system for delivering the adhesive material to the locations where the adhesive bond between the blade holder 104 and the blade element 130 is to be formed. The injection of adhesive material should be sufficient to fill the blade holder cavity 120 with the adhesive 150 and to bond the blade holder 104 to the blade element 130.

As previously described, the blade holder 104 and the blade element 130 are preferably arranged such that the first longitudinal blade holder edge 112 is substantially parallel with and adjacent to the first longitudinal blade element edge 136. As also described above, the blade holder 104 preferably further includes the angled side member 170 connected to the first longitudinal blade holder edge 112 and extending away from the blade element 130. The upper mold plate 192 is appropriately shaped to accommodate the foregoing structural features of the blade holder 104.

To achieve maximum production efficiency, the manufacturing process of FIGS. 9A and 9B preferably further includes the step of forming the toner metering strip 180 on the second blade element face 134, with the strip being positioned substantially adjacent to the second longitudinal blade element edge 138. To perform this manufacturing step, the blade element 130 must include the blade element injection ports 182 (or equivalents thereof) extending from the first blade element face 132 to the second blade element face 134 for injecting material therethrough to form the strip 180.

The mold 190 is also provided with a strip-forming cavity 198 located in the lower mold plate 194 so as to be adjacent to the second blade element face 134 and in fluid communication with the blade element injection ports 182 when the mold 190 is closed. The mold 190 is further provided with mold gates 200 located so as to be in fluid communication with the blade element injection ports 182 at the first blade element face 132 when the mold 190 is closed.

After the mold 190 is closed, a quantity of strip-forming material is injected into the mold gates 200 in a quantity that is sufficient to fill the strip-forming cavity 198 of the lower mold plate 194 with the strip-forming material, and to form a strip on the blade element 130. Preferably, the strip forming material is the same material as the adhesive introduced into the gate(s) 196, e.g., silicone rubber. The material is preferably injected into the mold gates 196 and 200 substantially simultaneously. Advantageously, when the toner metering blade 102 is removed from the mold 190 following the molding cycle, sprues of the injected material will remain in the injection ports 160 and 182. This will strengthen the bond between the injected material and the blade holder 104 and blade element 130, respectively.

Figure 10:
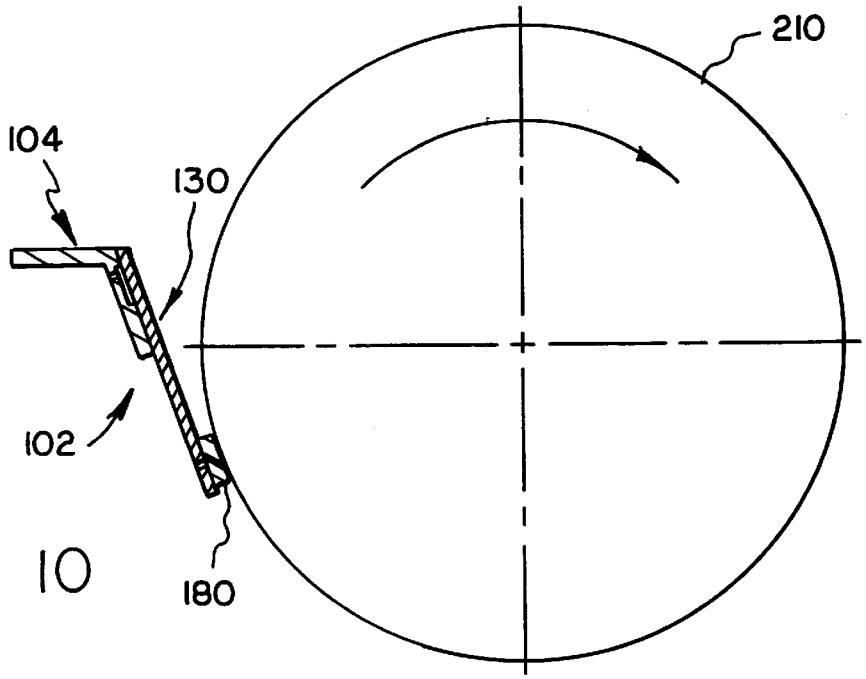
FIG. 10 is a side elevational view showing the toner metering blade of FIG. 5 arranged for metering toner in a photocopying apparatus.

As shown in FIG. 10, the toner metering blade 104 produced in accordance with the foregoing process is ideally suited to be mounted in adjacent relationship with an image-forming component 210 situated in a toner cartridge or the like. In the configuration shown, the blade holder 104 mounts to a fixed structural portion of the cartridge such that the toner metering strip 180 is presented to the toner-bearing face of the rotating image-forming component 210. Due to the ability to control tolerances in the toner metering blade 102, the positioning of the toner metering strip 180 is precisely controlled and the operation of the image-forming component 210 is enhanced.

Accordingly, a toner metering blade and manufacturing process therefor have been shown and described wherein a blade holder and a blade element can be bonded together, and a toner metering strip formed on one face of the blade element, in a single molding and material injection operation. While various embodiments have been disclosed, it should be apparent that many variations and alternative embodiments would be apparent to those skilled in the art in view of the teachings herein. For example, FIGS. 9A and 9B show a process wherein the blade element 130 is placed on the lower mold plate 194 and the blade holder 104 is placed on top of the blade element. This is followed by closing the upper mold plate 192. The process could be modified if necessary by reversing the positions of the mold plates so that the mold plate 192 becomes the lower mold plate and the mold plate 194 becomes the upper mold plate. In that case, the blade holder 104 would be the first component placed in the mold, i.e., on top of the mold plate 192. The blade element 130 would then be placed on top of the blade holder 104 and the mold plate 194 would be closed. It is understood, therefore, that the invention is not to be in any way limited except in accordance with the spirit of the appended claims and their equivalents.

What is claimed is:

1. A toner metering blade comprising:

an elongated blade holder including:

an elongated base member having a first blade holder face, a second blade holder face that is substantially parallel to said first blade holder face, a first longitudinal blade holder side edge, a second longitudinal blade holder side edge, a first blade holder end and a second blade holder end; and an open cavity formed in said first blade holder face for receiving an adhesive material;

an elongated blade element having a first blade element face, a second blade element face that is substantially parallel to said first blade element face, a first longitudinal blade element edge, a second longitudinal blade element edge, a first blade element end and a second blade element end;

said blade element being disposed on said blade holder base member such that said first blade element face is in facing engagement with said first blade holder face, and with said blade element covering said cavity;

a quantify of adhesive in said cavity, said adhesive providing a bond between said blade holder and said blade element; and at least one blade holder injection port extending from said second blade holder face to said cavity for introducing said adhesive into said cavity.

2. A toner metering blade as set forth in claim 1 wherein said blade holder includes plural ones of said blade holder injection ports.

3. A toner metering blade as set forth in claim 2 wherein said cavity is an elongated cavity extending substantially parallel to said first and second blade holder longitudinal edges, and wherein said cavity has first and second ends disposed generally adjacent to said first and second blade holder ends, respectively.

4. A toner metering blade as set forth in claim 3 wherein said blade holder and said blade element are arranged such that said first longitudinal blade holder edge is parallel with and generally adjacent to said first longitudinal blade element edge.

5. A toner metering blade as set forth in claim 4 wherein said blade holder further includes an angled side member connected to said first longitudinal blade holder edge and extending away from said blade element.

6. A toner metering blade as set forth in claim 5 wherein said blade element includes a toner metering strip mounted on said second blade element face generally adjacent to said second blade element edge.

7. A toner metering blade as set forth in claim 6 wherein said blade element includes plural blade element injection ports extending from said first blade element face to said second blade element face for injecting material therethrough to form said strip.

8. A toner metering blade as set forth in claim 2 wherein said strip is made from the same material as said adhesive.

9. A toner metering blade as set forth in claim 8 wherein said same material fills said blade holder injection ports and said blade element injection ports.

10. A method for manufacturing a toner metering blade, comprising the steps of:

providing an elongated blade holder including:

an elongated base member having a first blade holder face, a second blade holder face that is substantially parallel to said first blade holder face, a first longitudinal blade holder side edge, a second longitudinal blade holder side edge, a first blade holder end and a second blade holder end;

an open blade holder cavity formed in said first blade holder face for receiving an adhesive material; and at least one blade holder injection port extending from said second blade holder face to said cavity;

providing an elongated blade element having a first blade element face, a second blade element face that is substantially parallel to said first blade element face, a first longitudinal blade element edge, a second longitudinal blade element edge, a first blade element end and a second blade element end;

placing said blade holder base member onto said blade element such that said first blade element face is in facing engagement with said first blade holder face, and with said blade element covering said blade holder cavity;

closing a mold around said blade holder and said blade element, said mold being shaped to receive said blade holder and said blade element therein and including a first mold gate that is located so as to be in fluid communication with said blade holder injection port when said mold is closed around said blade holder and said blade element; and injecting a quantity of adhesive material into said first mold gate, said injecting of said adhesive material being sufficient to fill said blade holder cavity with said adhesive and bond said blade holder to said blade element.

11. A method as set forth in claim 10 wherein said blade holder includes plural ones of said blade holder injection ports and said mold includes plural ones of said first mold gates.

12. A method as set forth in claim 11 wherein said blade holder cavity is an elongated cavity extending substantially parallel to said first and second blade holder longitudinal edges, and wherein said cavity has first and second ends disposed generally adjacent to said first and second blade holder ends, respectively.

13. A method as set forth in claim 12 said blade holder and said blade element are arranged such that said first longitudinal blade holder edge is generally parallel with and adjacent to said first longitudinal blade element edge.

14. A method as set forth in claim 13 wherein said blade holder further includes an angled side member connected to said first longitudinal blade holder edge and extending away from said blade element.

15. A method as set forth in claim 14 further including forming a strip on said second blade element face, said strip being positioned generally adjacent to said second longitudinal blade element edge.

16. A method as set forth in claim 15, wherein said blade element includes plural blade element injection ports extending from said first blade element face to said second blade element face for injecting material therethrough to form said strip.

17. A method as set forth in claim 16, wherein said mold further includes:

a) a strip-forming cavity located so as to be adjacent to said second blade element face and in fluid communication with said blade element injection ports when said mold is closed around said blade holder and said blade element; and b) a second mold gate located so as to be in fluid communication with said blade element injection port at said first blade element face when said mold is closed around said blade holder and said blade element;

and wherein said method further includes:

injecting a quantity of strip-forming material into said second mold gate, said injecting of said strip-forming material being sufficient to fill said strip-forming cavity with said strip-forming material and form a strip on said blade element.

18. A method as set forth in claim 17, wherein said strip is made from the same material as said adhesive.

19. A method as set forth in claim 18, wherein said same material is injected into said first and second mold gates substantially simultaneously.

20. A toner metering blade product made according to a toner metering blade manufacturing process comprising the step of:

bonding together a blade holder and a blade element via a bond, and forming a toner metering strip on one face of said blade element, in a single molding and material injection operation by configuring said blade holder to provide a hot runner system for forming said bond, and configuring said blade element to provide a hot runner system for forming said toner metering strip, said bond and said toner metering strip being formed from the same material during said molding and material injection step.

* * * * *